United States Patent [19]

Rios

[11] 4,112,336

[45] * Sep. 5, 1978

[54] LAMP-STARTING DEVICE

[76] Inventor: Donald J. Rios, 3923 Cranberry La., St. Louis, Mo. 63121

[ * ] Notice: The portion of the term of this patent subsequent to Jan. 25, 1994, has been disclaimed.

[21] Appl. No.: 747,520

[22] Filed: Dec. 6, 1976

Related U.S. Application Data

[63] Continuation-in-part of Ser. No. 635,649, Nov. 26, 1975, Pat. No. 4,005,338.

[51] Int. Cl.[2] ..... H05B 39/02

[52] U.S. Cl. ..... 315/362; 315/71; 315/107; 338/219

[58] Field of Search ..... 315/71–73, 315/75, 94, 102, 106, 107, 119, 127, 200 R, 362; 338/200, 215, 219; 339/176 L

[56] References Cited

U.S. PATENT DOCUMENTS

| | | | |
|---|---|---|---|
| 2,110,690 | 3/1938 | Zierahn | 315/71 X |
| 2,550,169 | 4/1951 | Sokoloff | 338/219 X |
| 3,868,540 | 2/1975 | Passmore | 315/73 |
| 4,005,338 | 1/1977 | Rios | 315/362 |

*Primary Examiner*—Eugene R. LaRoche

*Attorney, Agent, or Firm*—Cohn, Powell & Hind

[57] ABSTRACT

A lamp-starting device for use in a lamp socket adapted to receive the base of a lamp, the device having a pair of electrically-conductive plates disposed in spaced relation in and electrically insulated from each other by a housing of electrically insulating material. An electrical resistor is located between and electrically connects the plates, the resistor being in the circuit when the lamp is initially energized. A temperature-actuated mercury switch is located between the plates, the mercury switch being electrically connected to and located in heat transfer relation to the plate that is adapted to engage the lamp base. The mercury switch electrically interconnecting the plates when the mercury is heated by conductive heat from the lamp socket to bypass the resistor in the circuit after initial energization. The well and expansion tube of the mercury switch are formed in one side of the plate that is adapted to engage the lamp socket, and are enclosed by an electrically-insulating member disposed over the plate side. A conductor is electrically connected to the other plate and extends through the electrically-insulating member and into the tube for electrical engagement with the mercury upon expansion of the mercury when heated.

5 Claims, 5 Drawing Figures

LAMP-STARTING DEVICE

CROSS-RELATED APPLICATION:

This application is a continuation-in-part of co-pending application Ser. No. 635,649, filed Nov. 26, 1975, now U.S. Pat. No. 4,005,338.

BACKGROUND OF THE INVENTION

This invention relates generally to a lamp-starting device and to improvements in a device of this type in which means located in the circuit applies less than rated voltage to the lamp when the lamp is initially energized, and means in the circuit completely electrically bypasses the first said means in the circuit and applies substantially rated voltage to the lamp after the lamp is heated. More particularly, a temperature-actuated mercury switch is a component part so that a resistor is either completely in or out of the lamp circuit, the mercury switch being operated by conductive heat from the lamp socket.

The prior conventional lamp-starting devices utilized a negative temperature coefficient resistor in series with the lamp, the resistor being heated by current passing through the resistor. With this type of device, the resistance in the circuit decreases as the temperature of the negative temperature coefficient resistor increases. Accordingly, the resistor is at all times in circuit with the lamp.

SUMMARY OF THE INVENTION

The present lamp-starting device is of compact, simple construction that places a resistance of definite fixed value in the lamp circuit when the lamp circuit is initially energized, and which utilizes a temperature-actuated mercury switch that operates with a positive action to bypass the resistor when the mercury of the mercury switch is heated by conductive heat from the lamp base and socket. The resistor is either completely in or out of the circuit.

For example, with this device, the lamp is turned on at about three-fourths rated voltage. After about ten seconds, the conductive heat from the lamp base and socket to the lamp starter will cause the mercury of the mercury switch to expand, to close the mercury switch and bypass the resistor so that full rated voltage is applied to the lamp to operate at full rated capacity. Because the lamp is turned on at a relatively low voltage, and full rated voltage is applied only after the lamp filament is relatively warm, the lamp life is increased significantly.

The lamp-starting device includes an electrical resistor located between and electrically connecting a pair of electrically conductive plates disposed in a housing of electrically-insulating material, the plates being in spaced relation and electrically insulated from each other by the housing. A temperature-actuated mercury switch is located between the plates, and is located in heat transfer relation to the plate that is adapted to engage the lamp base so that when the mercury switch is heated by conductive heat from the lamp base and lamp socket, the resistor in the circuit is bypassed after initial energization.

The temperature-actuated mercury switch includes a mercury well with mercury electrically connected to and located in heat transfer relation to the plate that is adapted to engage the lamp base, and includes means electrically connecting the mercury to the other plate when the mercury is heated and expanded by conductive heat from the lamp base and socket to bypass the resistor in the circuit.

More particularly, the well and expansion tube of the mercury switch are formed in one side of the plate that is adapted to engage the lamp base. An electrically-insulated member is disposed over this plate side to enclose the well and tube and retain the mercury. A conductor is connected to the other plate and extends through the electrically-insulated member and into the tube for electrical contact with the mercury when the mercury is heated and expanded.

DESCRIPTION OF THE PREFERRED EMBODIMENT

Figure 1:
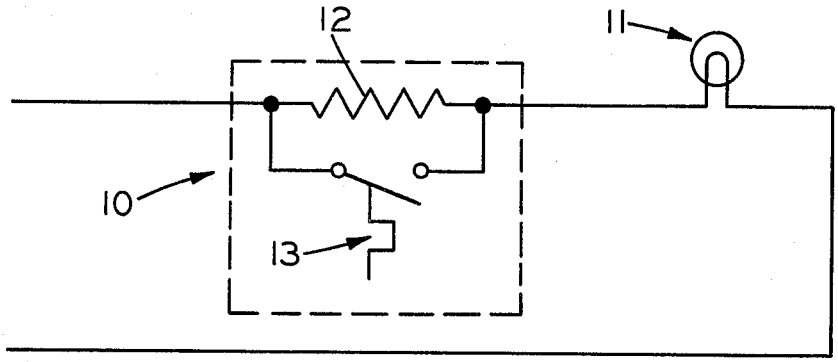
FIG. 1 is a circuit diagram of the lamp and lamp-starting device.

Referring now by characters of reference to the drawings and first to FIG. 1, a circuit diagram is illustrated in which the lamp-starting device generally indicated by 10 is connected in the circuit with the lamp 11. In this circuit diagram, the lamp-starting device 10 includes a resistor 12 connected in series with the lamp 11, and a temperature-actuated mercury switch referred to generally by 13 connected in parallel with the resistor 12.

Figure 2:
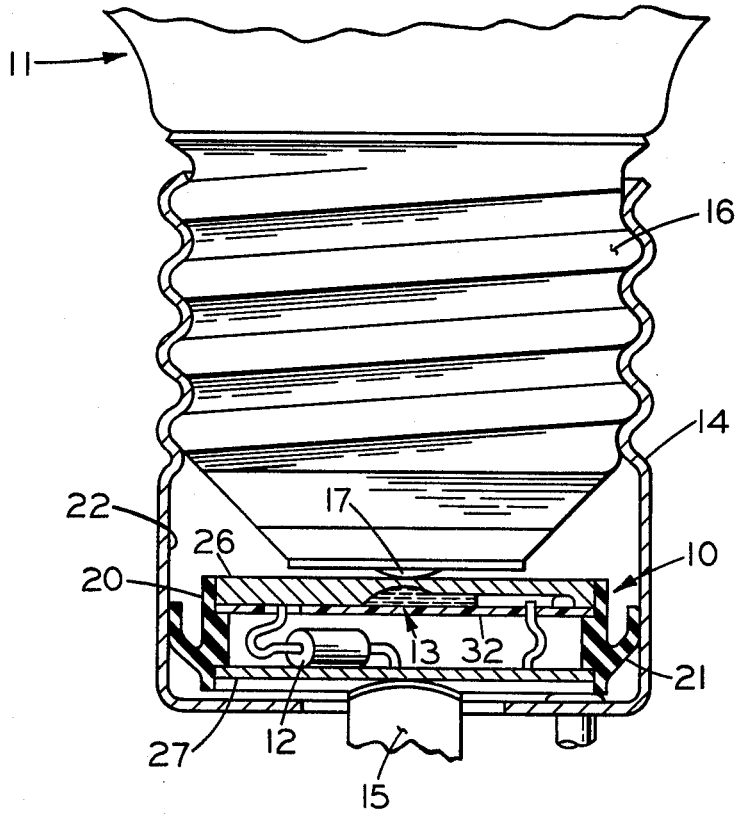
FIG. 2 is a fragmentary, enlarged cross-sectional view of the lamp starting device in a lamp socket.
Figure 3:
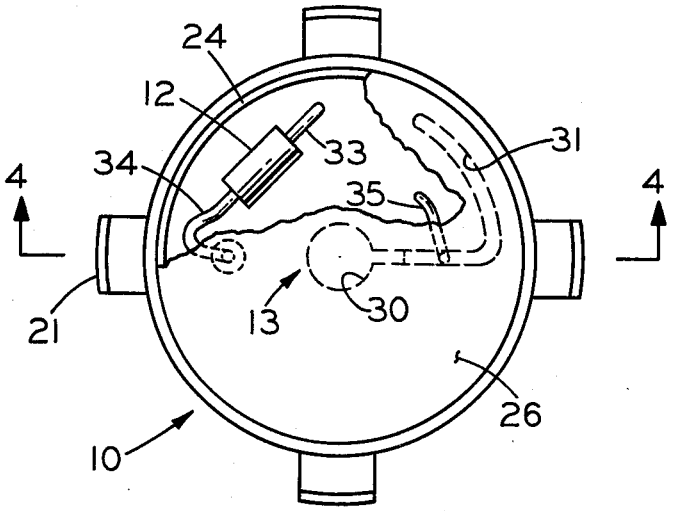
FIG. 3 is a top plan view of the lamp-starting device with its top plate partially cut away to show the interior assembly.

In FIG. 2, the lamp-starting device 10 is disposed in the bottom of a lamp socket 14. The lamp socket 14 includes as a component part, a contact 15 that is electrically connected to the lamp-starting device 10 in a manner later described in detail. The lamp 11 includes a base 16 that is threadedly connected in and to the lamp socket 14. The lamp base 16 includes an electrical contact 17 that is electrically connected to the lamp-starting device 10 in a manner later described.

Figure 4:
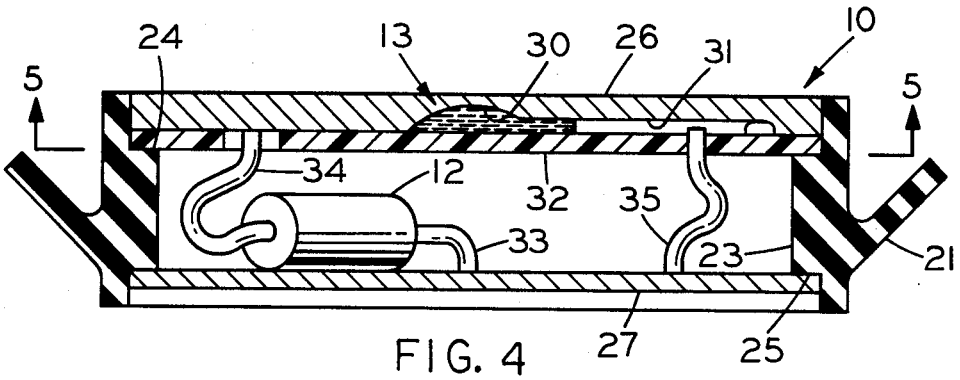
FIG. 4 is an enlarged, cross-sectional view of the lamp starting device as seen on line 4—4 of FIG. 3.
Figure 5:
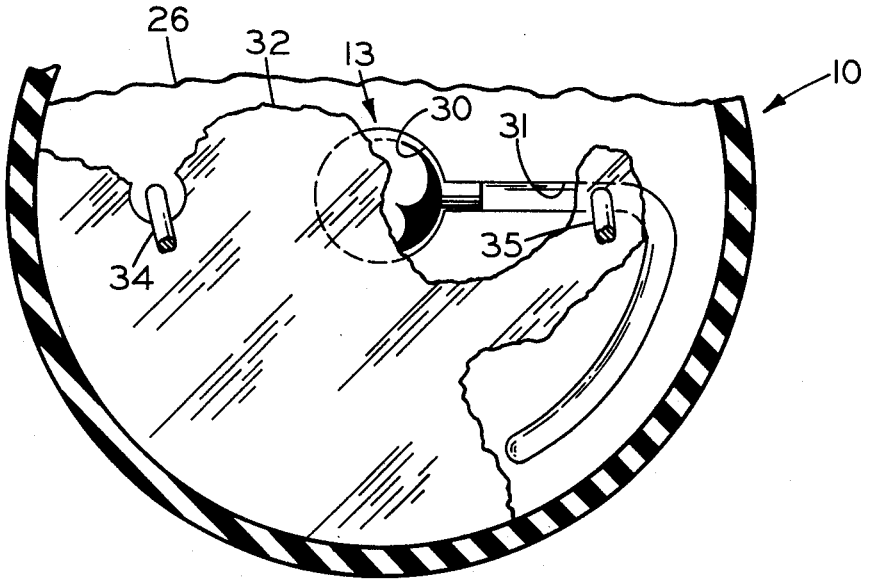
FIG. 5 is a fragmentary, cross-sectional view as seen on line 5—5 of FIG. 4.

The lamp-starting device 10 includes a substantially cylindrical housing 20 made of electrically insulating material. The housing 20 includes a plurality of flexible tabs 21 spaced about its periphery, the tabs 21 resiliently engaging the inside wall 22 of lamp socket 14 to position and hold the lamp-starting device in place. The housing 20 also includes an internal, integral ring 23 as shown in FIG. 4 providing an upper peripheral shoulder 24 and a lower peripheral shoulder 25.

A pair of electrically-conductive metal plates 26 and 27 are disposed in spaced relation in and electrically insulated from each other by the housing 20. Plate 27 is seated on and is fixed to the internal housing shoulder 25.

A temperature-actuated mercury switch generally indicated by 13 is located between the plates 26 and 27 and is electrically connected to and located in heat transfer relation to the plate 26 that is adapted to engage the lamp base 16. More particularly, the mercury switch 13 includes a mercury well 30 and associated expansion tube 31 formed in one side of the plate 26. Bonded to the same side of the plate 26, is an electrically insulated member 32 that covers the well 30 and expansion tube 31 to retain the mercury. The plate 26 and the electrically-insulating member 32 are located as a unit in the housing 20 with the electrically-insulating member 32 seated on and fixed to the internal housing shoulder 24.

Located between and electrically connecting the plates 26 and 27 is an electrical resistor 12. The resistor 12 has one lead 33 connected as by solder to the plate 27, and has another lead 34 extending through the electrically-insulating member 32 and connected as by solder to the plate 26.

When the lamp-starting device 10 is installed in the lamp socket 14 as is illustrated in FIG. 2, the socket contact 15 engages the plate 27. When the lamp 11 is fully attached to the lamp socket 14, the base contact 17 engages the plate 26. Consequently, when the circuit is initially energized, the resistor 12 is effectively in the circuit in series with the lamp filament.

The temperature-actuated mercury switch includes a conductor 35 connected as by solder to the plate 27 and extending through the electrically-insulating member 32 and into the expansion tube 31 of plate 26. It will be understood that when the mercury is sufficiently heated by conductive heat from the lamp base 16 and socket 14, the mercury will expand into the tube 31 and electrically contact the conductor 35 to bypass the resistor 12 in the electrical circuit so that full rated voltage is applied to the lamp filament. The path of current flow is then through the mercury of the mercury switch 13 and conductor 35.

It is thought that the usage and functional advantage of this lamp-starting device 10 has become fully apparent from the foregoing detailed description, but for completeness of disclosure, the installation of the lamp starter device 10 and its operation will be briefly described.

First, the lamp-starting device 10 is inserted into the lamp socket 14 by threadedly inserting the housing tabs 21 and then pressing the housing 20 to the bottom of the socket 14 until the socket contact 15 engages the plate 27. The housing tabs 21 resiliently engage the internal wall 22 of the lamp socket 14 and retain the device 10 in place.

Then, the lamp 11 is installed in the lamp socket 14 by threadedly inserting the lamp base 16. The base contact 17 will engage the plate 26 of the lamp-starting device 10.

When the lamp circuit is initially energized, current to the lamp filament will flow from the socket contact 15 to the lamp base contact 17, through the resistor 12 and through the plates 26 and 27. Because the resistor 12 is in series with the lamp filament, the lamp is turned on at less than rated voltage.

After a short time period, the conducted heat from the lamp base 16 and socket 14 to the lamp-starting device 10, and particularly to the plate 26, will cause the mercury in the temperature-actuated mercury switch 10 to expand until the mercury effectively engages the conductor 35, thereby closing the switch so as to effectively and completely bypass the resistor 12. The current flow from the socket contact 15 to the lamp base contact 17 will be through the mercury and switch conductor 35, and the plates 26 and 27. Consequently, full rated voltage is applied to the lamp 11 to operate at full rated capacity.

It will be importantly understood that the resistor 12 is either completely in or out of the lamp circuit. Upon initial energization of the circuit, the resistor 12 is completely in the circuit so that less than rated voltage, say only three-fourth voltage, is applied to the lamp 11. When the mercury effectively engages the switch conductor 35 of the mercury switch 13 when the mercury is heated and expanded by conductive heat from the lamp base 16 and socket 14, the resistor 12 is completely out of the circuit so that rated voltage is applied to the lamp 11. Because the lamp 11 is turned on at a relatively low voltage and full rated voltage is applied only after the lamp filament is relatively warm, the lamp life is increased significantly.

I claim as my invention:

1. A lamp-starting device for use in a lamp socket adapted to receive the base of a lamp, comprising:
   (a) a housing,
   (b) a pair of electrically-conductive plates disposed in spaced relation in the housing, and electrically insulated from each other,
   (c) an electrical resistor located between and electrically connecting the plates, the resistor being in the circuit when the lamp is initially energized, and
   (d) a temperature-actuated mercury switch located between the plates, the mercury switch being located in heat transfer relation to the plate that is adapted to engage the lamp base, and operatively electrically interconnecting the plates when the switch is heated by conductive heat from the lamp socket to the plate adapted to engage the lamp base to bypass the resistor in the circuit after initial energization.

2. A lamp-starting device as defined in claim 1, in which:
   (e) the temperature-actuated mercury switch includes a mercury well with mercury electrically connected to and located in heat transfer relation to the plate that is adapted to engage the lamp base, and
   (f) means electrically connecting the mercury to the other plate when the mercury is heated and expanded by conductive heat from the lamp socket to the plate adapted to engage the lamp base.

3. A lamp-starting device as defined in claim 2, in which:
   (g) the mercury engages the plate that is adapted to engage the lamp base.

4. A lamp-starting device as defined in claim 2, in which:
   (g) the mercury switch has the well and an expansion tube formed in the plate that is adapted to engage the lamp base.

5. A lamp-starting device as defined in claim 4, in which:
   (h) the well and expansion tube of the mercury switch are formed in one side of the plate that is adapted to engage the lamp base,
   (i) an electrically-insulating member is disposed over the plate side to enclose the well and tube, and
   (j) the said means of the mercury switch is a conductor electrically connected to the said other plate and extending through the electrically-insulating member and into the tube.

* * * * *